US008319690B2

(12) United States Patent
Oh

(10) Patent No.: US 8,319,690 B2
(45) Date of Patent: Nov. 27, 2012

(54) MOBILE TERMINAL HAVING ADDITIONAL ANTENNA PATTERN IN MAIN BODY

(75) Inventor: Kyung Jin Oh, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 777 days.

(21) Appl. No.: 12/284,812

(22) Filed: Sep. 25, 2008

(65) Prior Publication Data

US 2009/0102727 A1 Apr. 23, 2009

(30) Foreign Application Priority Data

Sep. 27, 2007 (KR) ..... 10-2007-0097436

(51) Int. Cl.
*H01Q 1/24* (2006.01)
*H01Q 9/30* (2006.01)

(52) U.S. Cl. ..... 343/702; 343/900; 343/909

(58) Field of Classification Search ..... None
See application file for complete search history.

(56) References Cited

U.S. PATENT DOCUMENTS

| | | | | | |
|---|---|---|---|---|---|
| 5,455,595 | A * | 10/1995 | Yokoyama et al. | ..... | 343/702 |
| 5,748,150 | A * | 5/1998 | Rudisill | ..... | 343/702 |
| 5,909,194 | A * | 6/1999 | Umeda et al. | ..... | 343/702 |
| 6,195,050 | B1 * | 2/2001 | Kim | ..... | 343/700 MS |
| 6,239,755 | B1 * | 5/2001 | Klemens et al. | ..... | 343/702 |
| 6,337,671 | B1 * | 1/2002 | Lee | ..... | 343/901 |
| 6,417,808 | B1 * | 7/2002 | Ide | ..... | 343/702 |
| 6,452,556 | B1 * | 9/2002 | Ha et al. | ..... | 343/702 |
| 6,768,464 | B1 * | 7/2004 | Shoji et al. | ..... | 343/702 |
| 7,221,324 | B2 * | 5/2007 | Kim | ..... | 343/702 |
| 7,292,192 | B2 * | 11/2007 | Aritake | ..... | 343/702 |
| 7,642,977 | B2 * | 1/2010 | Seo | ..... | 343/729 |
| 2004/0070542 | A1 * | 4/2004 | Takebe | ..... | 343/702 |

* cited by examiner

*Primary Examiner* — Trinh Dinh

(57) ABSTRACT

The present invention relates to a mobile terminal having an antenna pattern in a main body of the mobile terminal. The mobile terminal includes: a main body having a feed point; a first antenna disposed in the main body, and a second antenna; wherein the second antenna is connected to the first antenna when the first antenna is retracted into the main body. According to the present invention, a digital broadcast signal can be received efficiently without extending an antenna to the outside of a main body of a mobile terminal. Further, damage to an antenna and wear of an antenna connection part are decreased.

20 Claims, 5 Drawing Sheets

MOBILE TERMINAL HAVING ADDITIONAL ANTENNA PATTERN IN MAIN BODY

CROSS-REFERENCE TO RELATED APPLICATION(S) AND CLAIM OF PRIORITY

This application claims priority to an application entitled "MOBILE TERMINAL HAVING ADDITIONAL ANTENNA PATTERN IN MAIN BODY" filed in the Korean Intellectual Property Office on Sep. 27, 2007 and assigned Serial No. 2007-0097436, the contents of which are incorporated herein by reference.

TECHNICAL FIELD OF THE INVENTION

The present invention relates to a mobile terminal and, more particularly, to a mobile terminal in which an antenna is connected to an additional antenna pattern when the antenna is retracted into a main body of the mobile terminal.

BACKGROUND OF THE INVENTION

An antenna is an essential device for transmitting and receiving a radio wave in wireless communication. The length of the antenna is proportional to the wavelength of the radio wave. The wavelength is expressed in a formula $\lambda=c/f$, where $\lambda$ is a wavelength, f is a frequency, and c is a constant. Accordingly, the length of the antenna is inversely proportional to the frequency.

An antenna of a mobile terminal must be long enough to receive a digital broadcast signal in a low frequency band. In a conventional mobile terminal, a whip antenna is used to receive a digital broadcast signal. The whip antenna is retracted into the mobile terminal when not in use. The whip antenna of the mobile terminal is extended outwards when the mobile terminal is used to receive a digital broadcast signal. When receiving a digital broadcast signal, the whip antenna is extended to the outside of the mobile terminal and, thereby, becomes a correct length for the frequency of a digital broadcast signal. However, if the whip antenna is not extended outwards when receiving a broadcast signal, reception of the broadcast signal is unstable because the length of the whip antenna does not match the frequency of the digital broadcast signal.

Further, the whip antenna may be damaged, and its connection parts may be easily worn by repeated extension and retraction.

SUMMARY OF THE INVENTION

To address the above-discussed deficiencies of the prior art, it is a primary object of the present invention to provide a mobile terminal that improves performance of transmitting and receiving a signal in a specific frequency band without extending an antenna outwards.

The present invention further provides a mobile terminal that reduces the possibility of damage to, and wear of, an antenna connection part due to repeated extension and retraction.

A mobile terminal according to an exemplary embodiment of the present invention includes: a main body having a feed point; a first antenna disposed in the main body and extendable to the outside of the main body; and a second antenna; wherein the second antenna is connected to the first antenna when the first antenna is retracted into the main body, and transmission and reception of a signal is performed through the first antenna connected to the second antenna when the first antenna is retracted into the main body.

In some embodiments, the second antenna is a metal pattern. The second antenna may be disposed at a corner of the main body. The second antenna is formed in a meandering form. The first antenna is a rod antenna connected to the second antenna through a C-clip.

The mobile terminal may further include: a guide part formed in the main body along an inner surface of a longest side of the main body for guiding the first antenna; and a contact ring disposed at the outer end of the guide part and connected to the feed point, through which the first antenna passes.

The second antenna may be disposed at a lower corner of the main body. In some embodiments, the main body has at least one rib formed at a lower corner of the main body, and the second antenna is installed on the rib.

In some embodiments, the main body may have at least one rib formed on an inner surface of the main body adjacent to the lower corner thereof, and the second antenna is disposed in the casing of the main body along the rib. The second antenna is formed in a plating process. A portion of the second antenna is formed on a pattern carrier by plating, and the portion of the second antenna formed on the pattern carrier contacts with the C-clip.

The mobile terminal according to the present invention has a second antenna in its main body, and thereby a desired antenna gain may be obtained without extending the first antenna outwards. Further, the need to repeatedly extend and retract the first antenna is reduced, thereby reducing damage to the first antenna and wear of an antenna connection part.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

FIGS. 1 through 5B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged mobile terminal.

Hereinafter, exemplary embodiments of the present invention are described in detail with reference to the accompanying drawings. The same reference numbers are used throughout the drawings to refer to the same or like parts. Detailed descriptions of well-known functions and structures incorporated herein may be omitted to avoid obscuring the subject matter of the present invention.

Figure 1:
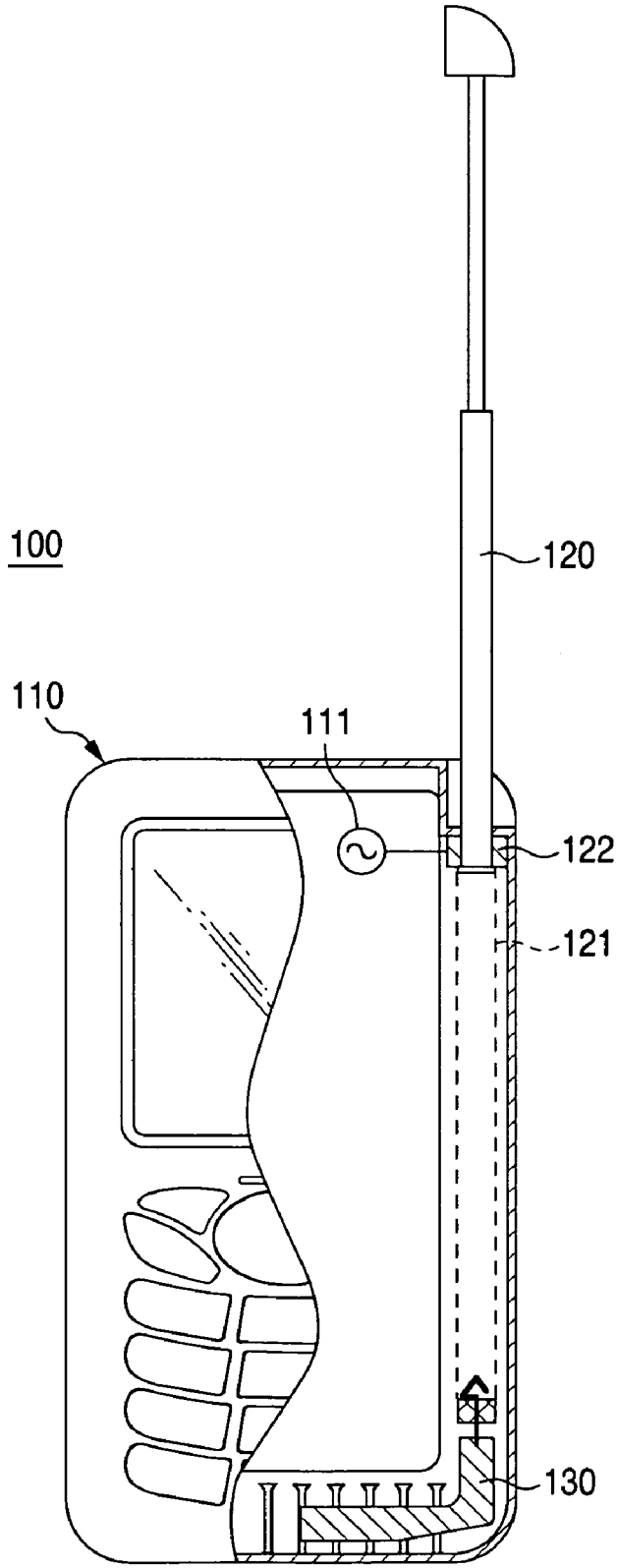
FIG. 1 is a schematic view showing a state in which a first antenna is extended to the outside of a main body in a mobile terminal according to an exemplary embodiment of the present invention.

FIG. 1 is a schematic view showing a state in which a first antenna is extended to the outside of a main body in a mobile terminal 100 according to an exemplary embodiment of the present invention.

Referring to FIG. 1, the mobile terminal 100 includes a main body 110, first antenna 120, and second antenna 130. A feed point 111 is formed within the main body 110. A signal is received through the first antenna 120, and transmitted to a demodulator of the mobile terminal 100 through the feed point 111. A signal for transmission modulated by a modulator of the mobile terminal 100 is transmitted to the first antenna 120 through the feed point 111.

The first antenna 120 is extended to the outside of the main body 110 when in use. A rod antenna is used as the first antenna 120 in this exemplary embodiment. However, a different type antenna may be used in another exemplary embodiment. A guide part 121 is formed within the main body 110 to support the first antenna 120. The guide part 121 is formed at an inner surface of a longest side of the main body 110. The first antenna 120 moves along the guide part 121. A contact ring 122 is disposed at the outer end of the guide part 121, and is connected to the feed point 111. The first antenna 120 is extended outwards through the contact ring 122. At least a portion of the first antenna 120 contacts with the contact ring 122, and thereby the first antenna 120 is always connected to the feed point 111 wherever the first antenna 120 is located.

Because the length of the first antenna 120 is inversely proportional to the frequency of a signal, the length of the first antenna 120 must be great enough to receive a digital broadcast signal in a low frequency band. A method of increasing the length of the first antenna 120 is performed by extending the first antenna 120 to the outside of the main body 110, and adjusting the length of the first antenna 120 for proper frequency resonance with a signal to be transmitted or to be received.

Figure 2:
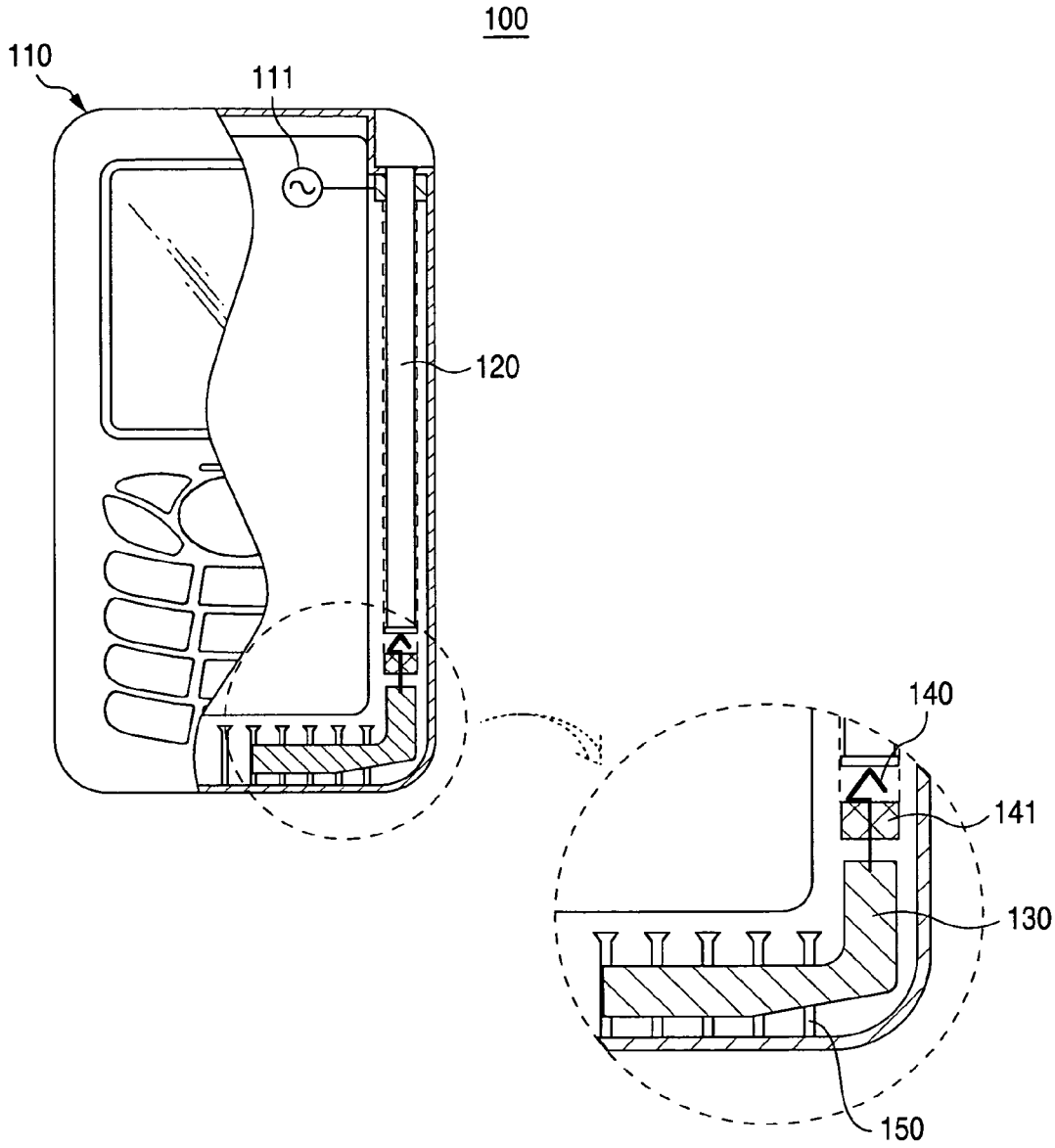
FIG. 2 is a schematic view showing a state in which the first antenna is retracted into the main body in the mobile terminal of FIG. 1.

FIG. 2 is a schematic view showing a state in which the first antenna 120 is retracted into the main body 110 in the mobile terminal of FIG. 1.

Referring to FIG. 2, the first antenna 120 may be used in a state in which the first antenna 120 is retracted into the main body 100. A second antenna 130 is located in the main body 110. When the first antenna 120 is retracted, the second antenna 130 is connected to the first antenna 120 through a C-clip 140. The second antenna 130 compensates for the length of the first antenna 120 reduced by the retraction. That is, the length of the second antenna 130 is set such that the sum of the length of the retracted first antenna 120 and the length of the second antenna 130 becomes a correct antenna length for transmission and reception of a signal. If the length of the second antenna 130 is set as described, the first antenna 120 can transmit and receive a signal efficiently in a state in which the first antenna is retracted into the main body 110.

When receiving a signal, the first antenna 120 and the second antenna 130 are connected to each other, and the received signal is transmitted to a demodulator through the first antenna 120 and the feed point 111. When transmitting a signal, a signal for transmission modulated by a modulator is transmitted through the feed point 111 and the first antenna 120 connected to the second antenna 130.

The second antenna 130 may be formed in a pattern, and the material of the second antenna 130 may be a metal like copper. The second antenna 130 may be disposed at a corner of the main body 110. If the second antenna 130 is disposed at a corner of the main body 110, the second antenna may be less influenced by other metals existing in the main body 110 than at other positions inside the main body 110. Furthermore, the second antenna 130 may be disposed at a lower corner of the main body 110 in some embodiments. Accordingly, when using the mobile terminal 100 as a phone, most of a user's head is located remote from the lower corner of the main body 110, and thereby the user may be less exposed to an electromagnetic wave.

The second antenna 130 may be disposed on ribs 150 formed at a corner of the main body 110. Mobile terminals generally have a plurality of ribs 150 for installation of an intenna (internal antenna) carrier. Because the second antenna 130 is disposed on the ribs 150 in this exemplary embodiment, no additional space is required for installation of the second antenna 130. Therefore, the internal space of the mobile terminal 100 can be used efficiently.

The C-clip 140 is used for an electric connection between the first antenna 120 and the second antenna 130. The C-clip 140 may be formed by bending a wire. A portion of the C-clip 140 adjacent to the second antenna 130 may be provided in a linear form and a portion adjacent to the first antenna 120 may be provided in a triangular form. The C-clip 140 is fixed in the main body 110 by a fixing part 141. When the first antenna 120 is retracted into the main body 110, the first antenna 120 stops by contacting with the C-clip 140. That is, the C-clip 140 acts as a stopper for the first antenna 120.

Figure 3:
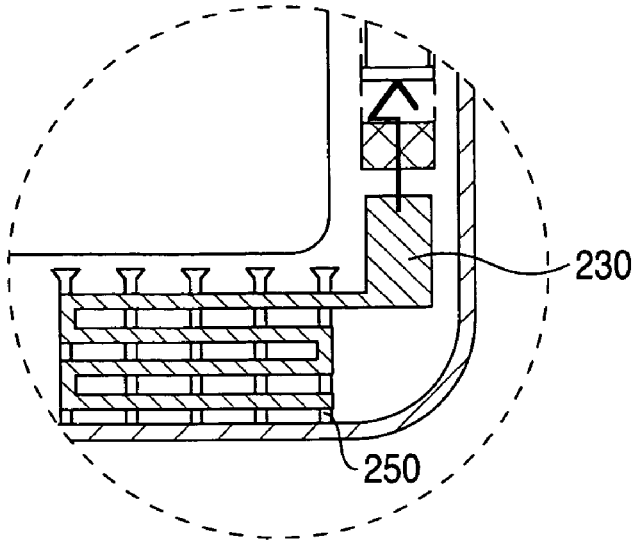
FIG. 3 is a partial view showing a mobile terminal having a second antenna in a meandering form according to another exemplary embodiment of the present invention.

FIG. 3 is a partial view showing a mobile terminal having a second antenna in a meandering form according to another exemplary embodiment of the present invention.

Referring to FIG. 3, a second antenna 230 may be formed in a meandering form having a plurality of bent portions. Most mobile terminals have a limited internal space, and therefore it is difficult to form the second antenna 230 having a desired length. By forming the second antenna 230 in a meandering form, the length of the second antenna 230 can be increased. By forming the second antenna 230 in a meandering form, the space covered by the second antenna 230 be reduced. The second antenna 230 can be installed stably by disposing on ribs 250.

Figure 4:
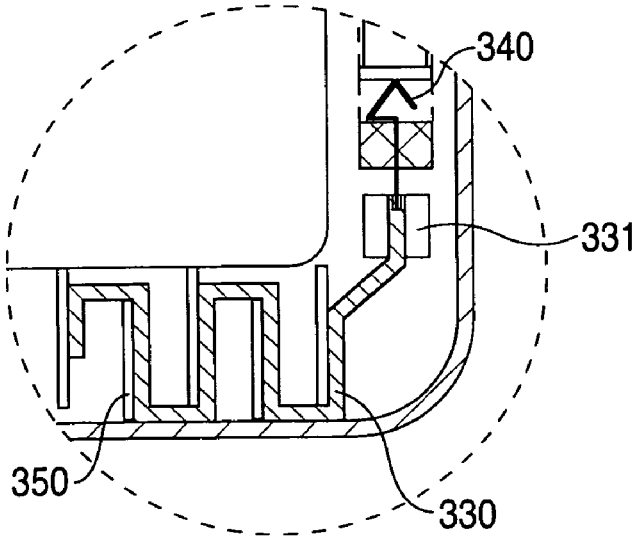
FIG. 4 is a partial view showing a mobile terminal having a second antenna formed by plating according to another exemplary embodiment of the present invention.

FIG. 4 is a partial view showing a mobile terminal having a second antenna formed by plating according to another exemplary embodiment of the present invention.

Referring to FIG. 4, a second antenna 330 may be disposed on an inner surface of a main body in a space adjacent to the ribs 350. That is, the second antenna 330 is formed in empty spaces between the ribs 350 and at a height less than that of the ribs 350. Accordingly, the internal space of the mobile terminal can be used efficiently. The second antenna 330 may be formed of copper in a plating process.

When the second antenna 330 is disposed on an inner surface of a main body, the height of the second antenna 330 becomes different from the height of a C-clip 340. The second antenna 330 is connected to the C-clip 340 through a pattern carrier 331 in order to overcome the separation due to the height difference between the second antenna 330 and the C-clip 340.

Figure 5A:
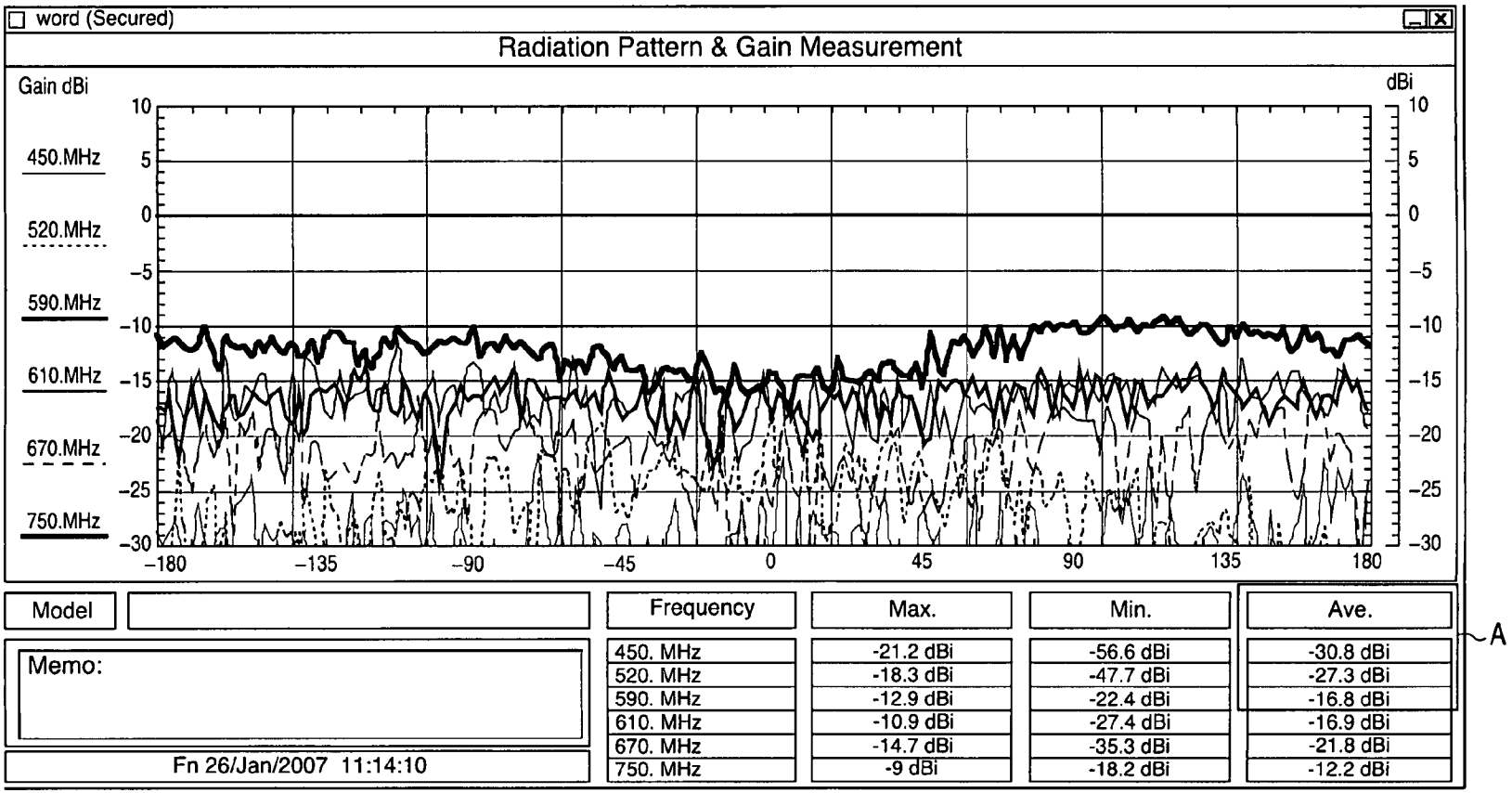
FIGS. 5A and 5B are graphs showing test results of signal reception performance in, respectively, a conventional mobile terminal and a mobile terminal having a second antenna according to the exemplary embodiments of the present invention.
Figure 5B:
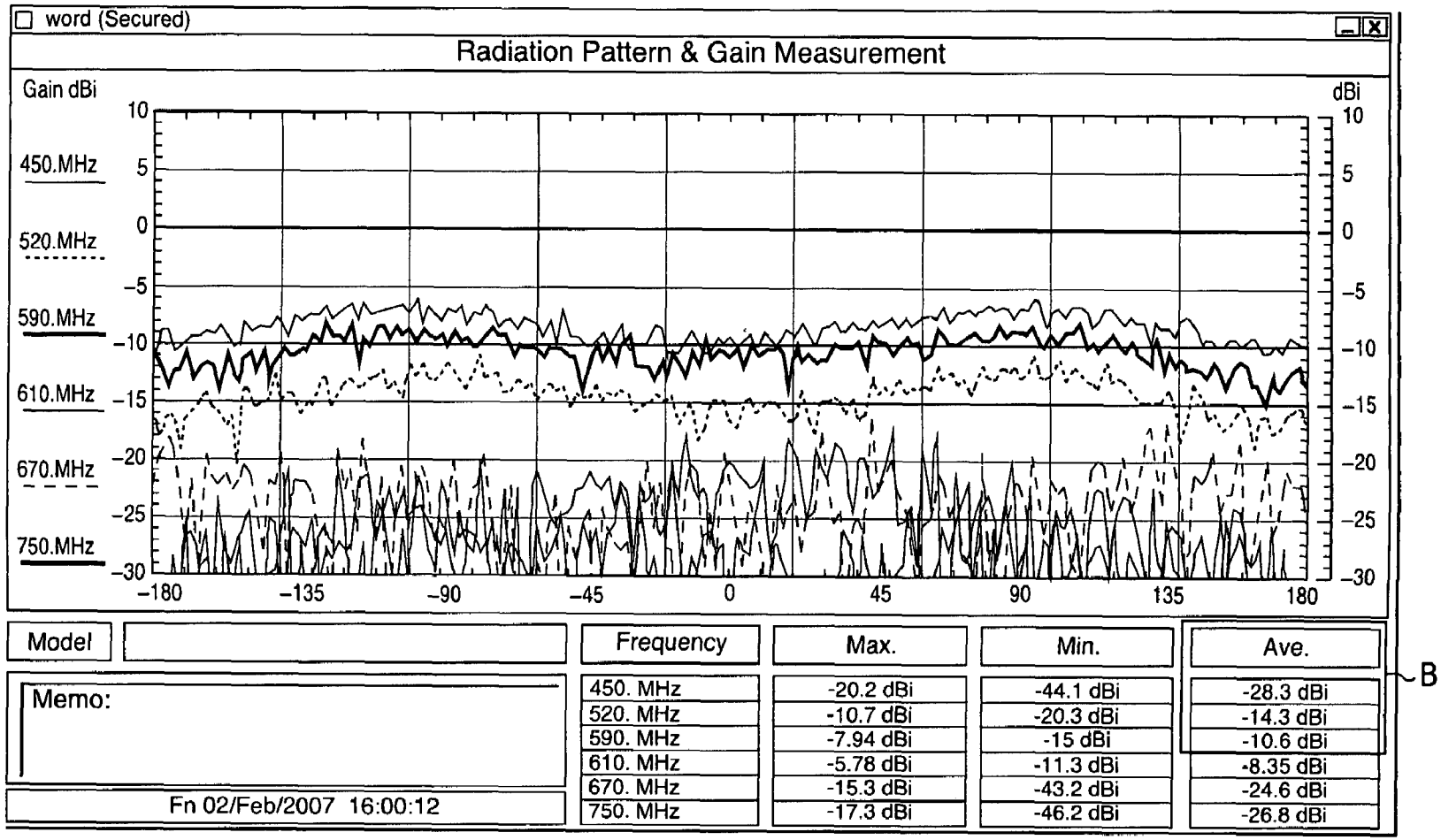

FIGS. 5A and 5B are graphs showing test results of signal reception performance in, respectively, a conventional mobile terminal and a mobile terminal having a second antenna according to the exemplary embodiments of the present invention.

A test was performed to evaluate a signal reception sensitivity of an antenna by measuring an antenna gain corresponding to a signal transmitted from a standard antenna. FIG. 5A is a graph showing a variation of antenna gain in a conventional mobile terminal having no second antenna and in a state that an antenna is retracted into a main body. FIG. 5B is a graph showing a variation of antenna gain in a mobile terminal having a second antenna according to the present invention and in a state that a first antenna is retracted into a main body. Referring to FIG. 5A, the conventional mobile terminal has average antenna gains: −30.8 dBi, −27.3 dBi, and −16.8 dBi, at 450 MHz, 520 MHz, and 590 MHz, respectively. Referring to FIG. 5B, the mobile terminal according to the present invention has average antenna gains: −28.3 dBi, −14.3 dBi, and −10.6 dBi, at 450 MHz, 520 MHz, and 590 MHz, respectively. That is, the average antenna gains of the mobile terminal according to the present invention are improved by 2.5 dB, 13 dB, and 6.2 dB, at 450 MHz, 520 MHz, and 590 MHz, respectively. Accordingly, it may be deduced that installation of a second antenna in a main body of a mobile terminal according to the present invention improves an antenna gain.

The mobile terminal according to the exemplary embodiments of the present invention may be any portable electronic equipment having a communication function, such as a mobile phone, PDA (personal digital assistant), MP3 Player, PMP (portable multimedia player), and digital broadcast receiver. Further, the present invention can be applied to a stationary terminal in addition to the mobile terminal.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A mobile terminal comprising:

a main body having a feed point;

a first antenna configured to be retractable into the main body and extendable to the outside of the main body, wherein the first antenna comprises a first length when the first antenna is retracted into the main body and a second length when the first antenna is fully extended outside the main body, and wherein the second length corresponds to a specified frequency band; and a second antenna configured to be coupled to the first antenna when the first antenna is retracted into the main body, wherein transmission and reception of a signal is performed through the first antenna coupled to the second antenna when the first antenna is retracted into the main body, and wherein a length of the second antenna corresponds to a difference between the first length and the second length of the first antenna such that the second antenna coupled to the retracted first antenna comprises a length corresponding to the specified frequency band.

2. The mobile terminal of claim 1, wherein when the first antenna is retracted into the main body, a tip of the first antenna does not extend beyond a top edge of the main body.

3. The mobile terminal of claim 2, wherein the second antenna is disposed at a corner of the main body.

4. The mobile terminal of claim 3, wherein the second antenna is formed in a meandering form.

5. The mobile terminal of claim 1, wherein the first antenna is a rod antenna and is connected to the second antenna through a C-clip.

6. The mobile terminal of claim 5, further comprising:

a guide part formed in the main body along an inner surface of a longest side of the main body for guiding the first antenna; and a contact ring disposed at an outer end of the guide part and connected to the feed point, through which the first antenna passes.

7. The mobile terminal of claim 5, wherein the second antenna is disposed adjacent to a lower corner of the main body.

8. The mobile terminal of claim 7, wherein the main body has at least one rib formed on an inner surface of the main body adjacent to the lower corner thereof, and the second antenna is installed on the rib.

9. The mobile terminal of claim 7, wherein the main body has at least one rib formed on an inner surface of the main body adjacent to the lower corner thereof, and the second antenna is disposed on the inner surface of the main body along the rib.

10. The mobile terminal of claim 9, wherein the second antenna is formed by a plating process.

11. The mobile terminal of claim 10, wherein the second antenna is connected to the C-clip through a pattern carrier.

12. A mobile terminal comprising:

a main body;

a first antenna configured to be retractable into the main body and extendable to the outside of the main body, wherein the first antenna comprises a first length when the first antenna is retracted into the main body and a second length when the first antenna is fully extended outside the main body, and wherein the second length corresponds to a specified frequency band; and a second antenna configured to be coupled to the first antenna when the first antenna is retracted into the main body, wherein a length of the second antenna corresponds to a difference between the first length and the second length of the first antenna such that a sum of the first length of the first antenna and the length of the second antenna corresponds to the specified frequency band.

13. The mobile terminal of claim 12, wherein when the first antenna is retracted into the main body, a tip of the first antenna does not extend beyond a top edge of the main body.

14. The mobile terminal of claim 12, wherein the second antenna is disposed at a corner of the main body.

15. The mobile terminal of claim 12, wherein the second antenna is formed in a meandering form.

16. The mobile terminal of claim 12, wherein the first antenna is a rod antenna and is connected to the second antenna through a C-clip.

17. The mobile terminal of claim 16, further comprising:

a guide part formed in the main body along an inner surface of a longest side of the main body for guiding the first antenna; and a contact ring disposed at the an outer end of the guide part and connected to a feed point of the main body, through which the first antenna passes.

18. The mobile terminal of claim 16, wherein the second antenna is disposed adjacent to a lower corner of the main body.

19. The mobile terminal of claim 18, wherein the main body has at least one rib formed on an inner surface of the main body adjacent to the lower corner thereof, and the second antenna is installed on the rib.

20. The mobile terminal of claim 18, wherein the main body has at least one rib formed on an inner surface of the main body adjacent to the lower corner thereof, and the second antenna is disposed on the inner surface of the main body along the rib.

* * * * *

UNITED STATES PATENT AND TRADEMARK OFFICE

CERTIFICATE OF CORRECTION

PATENT NO. : 8,319,690 B2
APPLICATION NO. : 12/284812
DATED : November 27, 2012
INVENTOR(S) : Oh It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 909 days.

Signed and Sealed this
Nineteenth Day of August, 2014

Michelle K. Lee

Michelle K. Lee
*Deputy Director of the United States Patent and Trademark Office*